United States Patent [19]

Meyer et al.

[11] Patent Number: 5,021,148

[45] **Date of Patent: * Jun. 4, 1991**

[54] METHOD OF REFINING COAL BY SHORT RESIDENCE TIME PARTIAL LIQUEFACTION TO PRODUCE PETROLEUM SUBSTITUTES AND CHEMICAL FEEDSTOCKS

[75] Inventors: Lee G. Meyer; Gerald F. Cavaliere, both of Englewood, Colo.

[73] Assignee: Carbon Fuels Corporation, Englewood, Colo.

[ * ] Notice: The portion of the term of this patent subsequent to Nov. 20, 2007 has been disclaimed.

[21] Appl. No.: 355,528

[22] Filed: May 23, 1989

Related U.S. Application Data

[63] Continuation-in-part of Ser. No. 277,603, Nov. 29, 1988, Pat. No. 4,938,782, and a continuation-in-part of Ser. No. 84,270, Aug. 11, 1987, Pat. No. 4,787,915, and a continuation-in-part of Ser. No. 59,288, Jun. 8, 1987, Pat. No. 4,832,831, and a continuation-in-part of Ser. No. 658,880, Oct. 9, 1984, Pat. No. 4,658,936.

[51] Int. Cl.[5] ..... C10G 1/00

[52] U.S. Cl. ..... 208/431; 208/433; 44/282

[58] Field of Search ..... 208/431, 433; 44/51, 44/282, 281

[56] References Cited

U.S. PATENT DOCUMENTS

| | | | |
|---|---|---|---|
| 4,450,066 | 5/1984 | Stone et al. | 208/431 |
| 4,551,224 | 11/1985 | Kuhlmann | 208/431 |
| 4,594,140 | 6/1986 | Cheng | 208/414 |
| 4,687,570 | 8/1987 | Sundaram et al. | 208/431 |
| 4,787,915 | 11/1988 | Meyer et al. | 44/51 |
| 4,832,831 | 5/1989 | Meyer et al. | 44/51 |
| 4,842,615 | 6/1989 | Meyer et al. | 208/431 |
| 4,842,719 | 6/1989 | MacArthur et al. | 208/431 |

*Primary Examiner*—Jacqueline V. Howard
*Attorney, Agent, or Firm*—Lee G. Meyer

[57] ABSTRACT

This invention generally relates to short residence time decomposition and volatilization of coal to produce liquid co-products, including petroleum substitutes and chamical feedstocks, while minimizing production of char and gas without utilization of external hydrogen, that is, hydrogen other than that contained in the coal feedstock. The invention more particularly relates to an improved partial coal liquefaction process for economically producing petroleum substitutes and chemical feedstocks from coal by a refining process employing short residence time vaporization and hydrogen conservation.

22 Claims, 1 Drawing Sheet

METHOD OF REFINING COAL BY SHORT RESIDENCE TIME PARTIAL LIQUEFACTION TO PRODUCE PETROLEUM SUBSTITUTES AND CHEMICAL FEEDSTOCKS

TECHNICAL FIELD

This application is a continuation-in-part of U.S. patent application Ser. No. 277,603 filed Nov. 29, 1988 now U.S. Pat. No. 4,938,782 issued July 3, 1990, and of its parent, U.S. patent application Ser. No. 084,270 filed Aug. 11, 1987 now U.S. Pat. No. 4,787,915 issued Nov. 29, 1988, and of its parent U.S. patent application Ser. No. 059,288 filed June 8, 1987, now U.S. Pat. No. 4,832,831 issued May 23, 1989, and of its parent, U.S. patent application Ser. No. 658,880 filed Oct. 9, 1984 now U.S. Pat. No. 4,658,936 issued Aug. 11, 1987.

These parent, grandparent, great-grandparent, and great-great-grandparent applications, which are incorporated in their entirety by reference as if they were completely set out herein, disclose a transportable fuel system as well as non-polluting, fluidic, completely combustible, transportable fuel compositions derived from coal, which compositions contain particulate coal char admixed with liquids obtained from pyrolysis, hydropyrolysis, and/or short residence time volatilization of coal and methods for making such a system and fuel compositions. The grandparent application further disclose that the process method can be altered to vary the product and co-product distribution as well as the rheological characteristics of the fuel system. The great-grandparent also disclose that the method of processing the coal, and specifically hydrodisproportionation, is important in determining both the economics of the process and the slate of products.

The immediate grandparents relate to volatilization of coal to produce char and liquid co-products without utilization of external hydrogen, i.e., hydrogen other than that contained in the coal feedstock, and more particularly to an improved method of economically producing uniform, fluidic, oil-type transportable fuel systems and fuel compositions and a slate of "value-added" co-products by a coal refining process employing short residence time high heating rate hydrodisproportionation.

The immediate parent relates to a rapid volatilization of the coal particle followed by an uncatalyzed hydrogenation reaction to conserve hydrogen and increase liquid yield.

BACKGROUND ART

Coal is the world's most abundant fossil fuel. However, coal has three major drawbacks: (1) Coal is a solid and is less easily handled and transported than fluidic or gaseous materials; (2) Coal contains compounds which, on burning, produce the pollutants associated with acid rain; and (3) Coal is not a uniform fuel product, varying in characteristics from region to region and from mine to mine.

In fossil fuels, the ratio of hydrogen atoms to carbon atoms is most important in determining the heating value per unit weight. The higher the hydrogen content, the more liquid (or gaseous) the fuel, and the greater its heat value. Natural gas, or methane, has a hydrogen-to-carbon ratio of 4 to 1 (this is the maximum); coal has a ratio of about 1 to 1; shale oil about 1.5 to 1; petroleum crude about 2.0 to 1; and gasoline almost 2.2 to 1.

The lignites, peats, and lower calorific value subbituminous coals have not had an economic use except in the vicinity of the mine site, for example, mine mouth power generation facilities. This is due primarily to the cost of shipping a lower Btu product as well as to the danger of spontaneous combustion because of the high content of volatile matter and high percentage of moisture which is characteristic of such coals.

Since low-rank coals contain high percentages of volatile matter, the risk of spontaneous combustion is increased by dehydration, even by the non-evaporation methods. Therefore, in order to secure stability of the dehydrated coal in storage and transportation, it has been necessary to cover the coal with an atmosphere of inert gas such as nitrogen or combustion product gas, or to coat it with crude oil so as not to reduce its efficiency as a fuel. However, these methods are not economical.

Waste coal has somewhat different inherent problems from those of the low-rank coals. Waste coal is sometimes referred to as a "non-compliance coal" because it is too high in sulfur per unit heat value to burn in compliance with the United States Environmental Protection Agency (EPA) standards. Other waste coal is too low in Btu to be transported economically. This coal represents not only an environmental problem (because it must be buried or otherwise disposed of), but also is economically unattractive.

The inefficient and expensive handling, transportation and storage of coal (primarily because it is a solid material) makes coal not economically exportable and the conversion of oil-fired systems to coal less economically attractive. Liquids are much more easily handled, transported, stored and fired into boilers.

Coal transportation problems are compounded by the fact that coal is not a heterogeneous fuel, i.e, coal from different reserves has a wide range of characteristics. It is not, therefore, a uniform fuel of consistent quality. Coal from one region (or even of a particular mine) cannot be efficiently combusted in boilers designed for coal from another source. Boilers and pollution control equipment must either be tailored to a specific coal or configured to burn a wide variety of material with a loss in efficiency.

The non-uniformity and transportation problems are compounded by combustion pollutants inherent in coal. Coal has inherent material which, upon combustion, creates pollutants which are thought to cause acid rain; specifically, sulfur compounds and nitrogen compounds. The sulfur compounds are of two types, organic and inorganic (pyritic). The fuel bound nitrogen, i.e., organic nitrogen in the coal, combusts to form $NO_x$. Further, because of the non-uniformity of coal it combusts with "hot spots". Some of the nitrogen in the combustive air (air is 75% nitrogen by weight) is oxidized to produce $NO_x$ as a result of the temperature created by these "hot spots". This so-called "thermal $NO_x$" has heretofore only been reduced by expensive, coal-fired, boiler modification systems.

Raw coal cleaning has heretofore been available to remove inorganic ash and sulfur but is unable to remove the organic nitrogen and organic sulfur compounds which, upon combustion, produce the $SO_x$ and $NO_x$ pollutants. Heretofore fluidized bed boilers, which require limestone as an $SO_x$ reactant, and scrubbers or $NO_x$ selective catalytic converters (so-called combustion, and post-combustion clean air technologies) have been the main technologies proposed to alleviate these pollution problems. These devices clean the combustion and flue gas rather than the fuel and are tremendously expensive from both capital and operating standpoints, adding to the cost of power. This added power cost not only increases the cost of domestically produced goods, but also ultimately diminishing this nation's competitiveness with foreign goods. Further, this inefficiency also produces more $CO_2$. $CO_2$ production has been linked by some with "global warming", i.e. an increase in the "greenhouse" effect.

It would, therefore, be advantageous to clean up the coal by removing the organic nitrogen (fuel nitrogen), as well as the organic sulfur while providing a uniform fuel with high reactivity and lower flame temperature to reduce the thermal NOhd x. In order to overcome some of the inherent problems with coal, various methods have been proposed for converting coal to synthetic liquid or gaseous fuels. These "synfuel" processes are capital intensive and require a great deal of externally supplied water and external hydrogen, i.e., hydrogen and water provided from other than the coal feedstock. The processes are also energy intensive in that most carbon atoms in the coal matrix are converted to hydrocarbons, i.e., no char. The liquefaction of coal involves hydrogenation using external hydrogen. This differs markedly from merely "rearranging" existing hydrogen in the coal molecule as in hydrodisproportionation.

Coal pyrolysis is a well-known process whereby coal is thermally volatilized by heating the coal out of contact with air. Different pyrolysis products may be produced by varying the conditions of temperature, pressure, atmosphere, and/or material feed. Thus, traditional pyrolysis is the slower heating of coal in the absence of oxygen to produce very heavy hydrocarbon tars and carbon (char) with the liberation of hydrogen.

In prior art pyrolysis, the coal is heated relatively slowly at lower heating rates and longer residence times such that the solid organic material undergoes a slow decomposition of the coal molecule at reaction rate $k_1$ to yield "decomposition" products, primarily free radical hydrocarbon pieces or fragments. These "decomposition" products undergo a rapid recomposition or "condensation" reaction at reaction rate $k_2$. The condensation reaction produces char and dehydrogenated hydrocarbons, thus liberating hydrogen and heavy (tarry) liquids. The decomposition reaction is not desirable in a refining type process because it liberates hydrogen (instead of conserving it) and produces heavy material and char. In prior art pyrolysis, when heating is slower such that $k_1$ (relatively slow reaction rate) and $k_2$ (relatively more rapid reaction rate) overlap, the dehydrogenation of the decomposition product, i.e., condensation reaction, is predominant. Because it is believed that unless the decomposition reaction take place rapidly ($k_1$ is large), this reaction and the condensation reaction will take place within the particle where there is little hydrogen present to effect the hydrogenation reaction.

Hydropyrolysis of coal to produce char, liquids, and gases from bituminous and subbituminous coals of various ranks attempted to add hydrogen such that decomposition products were hydrogenated. This process is sometimes called "partial liquefaction" and has been carried out in both the liquid and gaseous phases. As used herein, "partial liquefaction" is meant to include all thermally based coal conversion processes, whether catalyzed or not, wherein a partial pressure of hydrogen is present. The most economical of these processes take place under milder conditions. These processes have had only limited success. Without rapid heating rates, the decomposition material can not be hydrogenated by external hydrogen without use of extreme temperatures and pressures. These processes are known as "liquefaction".

In these so-called "liquefaction" processes, coal is treated with hydrogen to produce petroleum substitutes. These processes have been known for many years. Typically, these processes have mixed crushed coal with various solvents, with or without catalysts; heated the mixture to reaction temperature; and reacted the coal and hydrogen at high pressure and long residence times. These "liquefaction" processes require high pressure, usually above 2,000 psig; require long reaction residence times, 20 minutes to about 60 minutes; consume large quantities of expensive externally generated hydrogen; and produce large amounts of light hydrocarbon gases. Solvent addition and removal, catalyst addition and removal, high pressure feed system, high pressure long residence time reactors, high hydrogen consumption, and high pressure product separation and processing have made these processes uneconomical in today's energy market.

Partial liquefaction of coal by hydropyrolysis to produce char and pyrolysis liquids and gases from bituminous and subbituminous coals of various ranks attempted to add hydrogen such that decomposition products were hydrocracked. These processes have had only limited success.

In order to promote hydrogenation, more stringent reaction conditions were required, reducing the economic viability. Examples of such processes are disclosed in U.S. Pat. Nos. 4,704,134; 4,702,747; and 4,475,924. In such processes, coal is heated in the presence of hydrogen or a hydrogen donating material to produce a carbonaceous component called char and various hydrocarbon-containing oil and gas components. Many hydropyrolysis processes employ externally generated additional hydrogen which substantially increases the processing cost and effectively makes the process a "liquefaction" process.

A particular type of coal hydropyrolysis, flash hydropyrolysis, is characterized by a very short reactor residence time of the coal. Short residence time (SRT) processes are advantageous in that the capital costs are reduced because the feedstock throughput is so high. In SRT processes, high quality heat sources are required to effect the transformation of coal to char, liquids and gases.

In many processes, hydrogen is oxidized within the reactor to gain the high quality heat. However, the oxidation of hydrogen in the reactor not only creates water but also reduces the hydrogen available to hydrogenate hydrocarbons to higher quality fuels. Thus, in prior art processes, either external hydrogen is required or the product is degraded because valuable hydrogen is converted to water.

The prior art methods of deriving hydrogen for hydropyrolysis or partial liquefaction are either by: (1) purchasing or generating external hydrogen, which is very expensive; (2) steam-methane reforming followed by shift conversion and $CO_2$ removal as disclosed in a paper by J. J. Potter of Union Carbide; or (3) char gasification with oxygen and steam followed by shift conversion and $CO_2$ removal as disclosed in a paper by William J. Peterson of Cities Service Research and Development Company.

All three of these hydrogen production methods are expensive, and a high temperature heat source such as direct $O_2$ injection into the hydropyrolysis reactor is still required to heat and devolatilize the coal. In the prior art processes, either carbon (char) is gasified by partial oxidation such as in a Texaco gasifier (U.S. Pat. No. 4,491,456 to Schlinger and U.S. Pat. No. 4,490,156 to Marion et al.), or oxygen was injected directly into the reactor. One such system is disclosed in U.S. Pat. No. 4,415,431 (1983) of Matyas et al. When oxygen is injected directly into the reactor, it preferentially combines with hydrogen to form heat and water. Although this reactor gives high-quality heat, it uses up hydrogen which is then unavailable to upgrade the hydrocarbons. This also produces water that has to be removed from the reactor product stream and/or floods the reactor. Additionally, the slate of hydrocarbon co-products is limited.

Thus, it would be advantageous to have a means for producing: (1) a high-quality heat for volatilization, (2) hydrogen, and (3) other reducing gases prior to the reaction zone without producing large quantities of water and without using up valuable hydrogen.

Flash hydropyrolysis, however, also proved to have substantial drawbacks in that the higher heating rates needed for short residence time tend to thermally hydrocrack and gasify the material at lower pressures. This gasification reduces liquid yield and available hydrogen. Thus, attempts to increase temperature to effect flash reactions tended to increase the hydrocracking of the valuable liquids to gases.

In U.S. Pat. Nos. 4,671,800; 4,658,936; 4,832,831; and 4,878,915, it is disclosed that coal can be subjected to pyrolysis or hydropyrolysis under certain conditions to produce a particulate char, gas and a liquid organic fraction. The liquid organic fraction is rich in hydrocarbons, is combustible, can be beneficiated and can serve as a liquid phase for a carbonaceous slurry fuel system. The co-product distribution, for example, salable hydrocarbon fractions such as BTX and naphtha, and the viscosity, pumpability and stability of the slurry when the char is admixed with the liquid organic fraction are a function of process and reaction parameters. The rheology of the slurry is a function of solids loading, sizing, surfactants, additives, and oil viscosity.

Common volatilization reactors include the fluidized bed reactor which uses a vertical upward flow of reactant gases at a sufficient velocity to overcome the gravitational forces on the carbonaceous particles, thereby causing movement of the particles in a gaseous suspension. The fluidized bed reactor is characterized by large volumes of particles accompanied by long, high-temperature exposure times to obtain conversion into liquid and gaseous hydrocarbons. Thus, this type of reactor is not very conducive to short residence time (SRT) processing and may produce a large quantity of polymerized (tarry) hydrocarbon co-products.

Another common reactor is the entrained flow reactor which utilizes a high-velocity stream of reactant gases to impinge upon and carry the carbonaceous particles through the reactor vessel. Entrained flow reactors are characterized by smaller volumes of particles and shorter exposure times to the high-temperature gases. Thus, these reactors are useful for SRT-type systems.

In one prior art two-stage entrained flow reactor, a first stage is used to react carbonaceous char with a gaseous stream of oxygen and steam to produce hydrogen, oxides of carbon, and water. These products continue into the second stage where volatile-containing carbonaceous material is fed into the stream. The carbonaceous feed reacts with the first-stage gas stream to produce liquid and gaseous hydrocarbons, including large amounts of methane gas and char.

Prior art two-stage processes for the gasification of coal to produce primarily gaseous hydrocarbons include U.S. Pat. Nos. 4,278,445 to Stickler; 4,278,446 to Von Rosenberg, Jr.; and 3,844,733 to Donath. U.S. Pat. No. 4,415,431 issued to Matyas et al. shows use of char as a carbonaceous material to be mixed with oxygen and steam in a first-stage gasification zone to produce a synthesis gas. Synthesis gas, along with additional carbonaceous material, is then reacted in a second-stage hydropyrolysis zone wherein the additional carbonaceous material is coal to be hydropyrolyzed.

U.S. Pat. No. 3,960,700 to Rosen describes a process for exposing coal to high heat for short periods of time to maximize the production of desirable hydrocarbons.

One method of terminating the volatilization reaction is by quenching the products either directly with a liquid or gas, or by use of a mechanical heat exchanger. In some cases, product gases or product oil are used. Many reactors, including those for gasification have employed a quench to terminate the volatilization reaction and prevent polymerizing of unsaturated hydrocarbons and/or gasification of hydrocarbon products. Some have employed intricate heat-exchange quenches, for example, mechanical devices to attempt to capture the heat of reaction. One such quench scheme is shown in U.S. Pat. No. 4,597,776 issued to Ullman et al. The problem with these mechanical quench schemes is that they introduce mechanical heat-exchanger apparatus into the reaction zone. This can cause tar and char accumulation on the heat-exchanger devices, thereby fouling the heat exchanger.

Thus, if the coal has a hydrogen-to-carbon ratio of 1, and if the hydrogens on half the carbons could be transferred or "rearranged" to the other half of the carbons, then the result would be half the carbons with 0 hydrogens and half with 2 hydrogens. The first portion of carbons (with 0 hydrogens) is char; the second portion of carbons (with 2 hydrogens) is a liquid product similar to a petroleum fuel oil. If this could be accomplished using only hydrogen inherent in the coal, i.e., no external hydrogen source, then the coal could be refined in the same economical manner as petroleum, yielding a slate of refined hydrocarbon products and char.

It would be highly advantageous to have a fuel system which is easily and efficiently prepared solely from coal using no external water and producing a slate of clean burning, non-"acid rain" producing co-products, petroleum substitutes, and chemical feedstocks including benzene, toluene, xylene (BTX); ammonia; sulfur; naphtha; gasoline; diesel fuel; jet fuel; and the like.

Further, it would be highly advantageous to have a partial liquefaction process for refining coal wherein short residence times and internally generated hydrogen are used in mild conditions to efficiently produce larger quantities of hydrocarbon liquids without excess gasification of such products by high temperatures. In this manner, hydrogen in the coal could be preserved and maximized.

SUMMARY OF THE INVENTION

The instant invention relates to an improved method for refining coal by short residence time partial liquefaction to produce a high liquid hydrocarbon yield while simultaneously conserving valuable hydrogen.

It has now been unexpeditiously discovered that short residence time reactions to produce petroleum substitutes and chemical feedstocks can be carried out at lower pressures and higher volatilization temperatures to effect higher heating rates without attendant gas production and/or "condensation" reactions, thereby producing high hydrocarbon liquid yields. In accordance with the invention, particles of volatile-containing carbonaceous material are heated at a rate effective to rapidly decompose and volatilize the solid, organic material. The decomposition reaction volatilizes the solid organic material into hydrocarbon fragments and free radicals, causing them to "exit" the carbonaceous particle. These volatilized, hydrocarbon fragments are intimately contacted with a hydrogen donor-rich gaseous reducing atmosphere at a hydrogenation temperature effective to promote the "hydrogenation" of the fragments and free radical "hydrogen capping". Although some hydrocracking occurs (depending upon the hydrogenation temperature and pressure), the hydrogenation temperature and hydrogenation residence time are selected to reduce thermal hydrocracking and gasification. B rapidly heating the particles to a volatilization temperature to decompose the solid organic material and then hydrogenating at a hydrogenation temperature, stable, high quality hydrocarbon liquids are produced from internally generated hydrogen while minimizing gas production from both the "condensation" reaction and hydrocracking. Thus, high heating rates can be obtained to increase decomposition reaction rate while hydrogenation temperatures are selected to effect efficient hydrogenation of decomposition products, without promoting attendant gasification and/or decomposition reactions.

The present process involves an improved method for refining a volatile containing carbonaceous material in a partial liquefaction-type process to produce a slate of hydrocarbon-containing products at short residence time, preferably using internally generated hydrogen. The process contemplates a heating step wherein volatile-containing carbonaceous particles are rapidly heated at a rate effective to minimize condensation and the formation of char to volatilization temperatures effective to produce decomposed and volatilized product. The decomposed product is contacted with a hydrogen donor-rich gaseous atmosphere at a hydrogenation temperature to effect hydrogenation and hydrogen capping of the decomposed, volatilized material. The hydrogenation is accomplished at residence times effective to complete hydrogenation of the fragments. The hydrogenated material can then be quenched to a stabilization temperature below the reaction temperature to prevent deterioration of the liquid products to gas by thermal hydrocracking.

The heating rate in the heating step is such that the decomposition reaction rate is optimized. Contacting the volatilized material with a hydrogen, donor-rich gaseous reducing atmosphere is carried out at conditions such that said decomposed volatiles are hydrogenated. In a preferred embodiment, the hydrogen, donor-rich gaseous reducing atmosphere is obtained in substantial part from the carbonaceous material. In one embodiment, a hydrogen donor-rich gas and/or hydrogen is present in the HDP mixing gas.

In a greatly preferred embodiment, a partial oxidation reactor is used to produce the heat for volatilization/-decomposition and the hydrogen donor-rich gaseous atmosphere.

In another embodiment, the hydrocarbon-containing decomposition vapor from the reaction is subjected to an initial partial quench to hydrogenation temperatures in the presence of a hydrogen donor-rich gaseous reducing atmosphere. In one aspect, the vapor is contacted with a heavy oil component recovered from the hydrocarbon vapor and recycled. This initial quench, in addition to reducing the temperature of the decomposition vapor, increases the temperature of the heavy oil to a sufficiently high temperature to effect a "thermal cracking" of the heavy oil to lighter oil. In another embodiment, a hydrogen donor-rich gas, separated in a downstream gas separator is recycled as the initial quench media to effect a hydrogenation temperature and hydrogenate the volatilized material. In still another embodiment, a mixture of recycled hydrogen donor-rich gas and recycled heavy oil is used as a first quench stream to effect a hydrogenation temperature that selectively cracks heavy oil to lighter oil and hydrogenates the volatilized material. In accordance with a further preferred embodiment, the hydrogenated material is quenched further to effect stabilization, i.e., prevent further hydrocracking and/or condensation reaction of the liquids. Preferably, a second quench medium, which can comprise water and light cycle oil recovered from the hydrocarbon vapor, is used to reduce the temperature of the vapor to stabilization temperatures.

In a further embodiment, a catalyst can be injected with the feed coal or with the intermediate quench gas to enhance liquid hydrocarbon yield and produce a high quality, hydrogenated oil product.

In still another embodiment, a catalyst can be injected or mixed with the partially hydrogenated hydrocarbons downstream of the char separator, at a temperature and residence time effective in additional hydrogenation. Preferably, the reaction products from the liquefaction reaction are cooled to a hydrogenation temperature using hydrogen or hydrogen-rich gas. The hydrogen-rich vapor and hydrogenation temperature provide ideal conditions for the catalytic hydrogenation of the liquid hydrocarbons.

In another embodiment, methane or methane-rich gas containing other light hydrocarbon gases can be injected into the liquefaction reactor with the carbonaceous feed material or with the hot feed gas in a quantity effective to retard formation of methane and other light hydrocarbon gases from the carbonaceous feedstock. It has been discovered that addition of methane in short residence time reactors can significantly reduce the conversion of the hydrocarbonaceous feed material to methane, increase liquid hydrocarbon yields, and, therefore, significantly reduce hydrogen consumption.

DESCRIPTION OF THE PREFERRED EMBODIMENT

Figure 1:
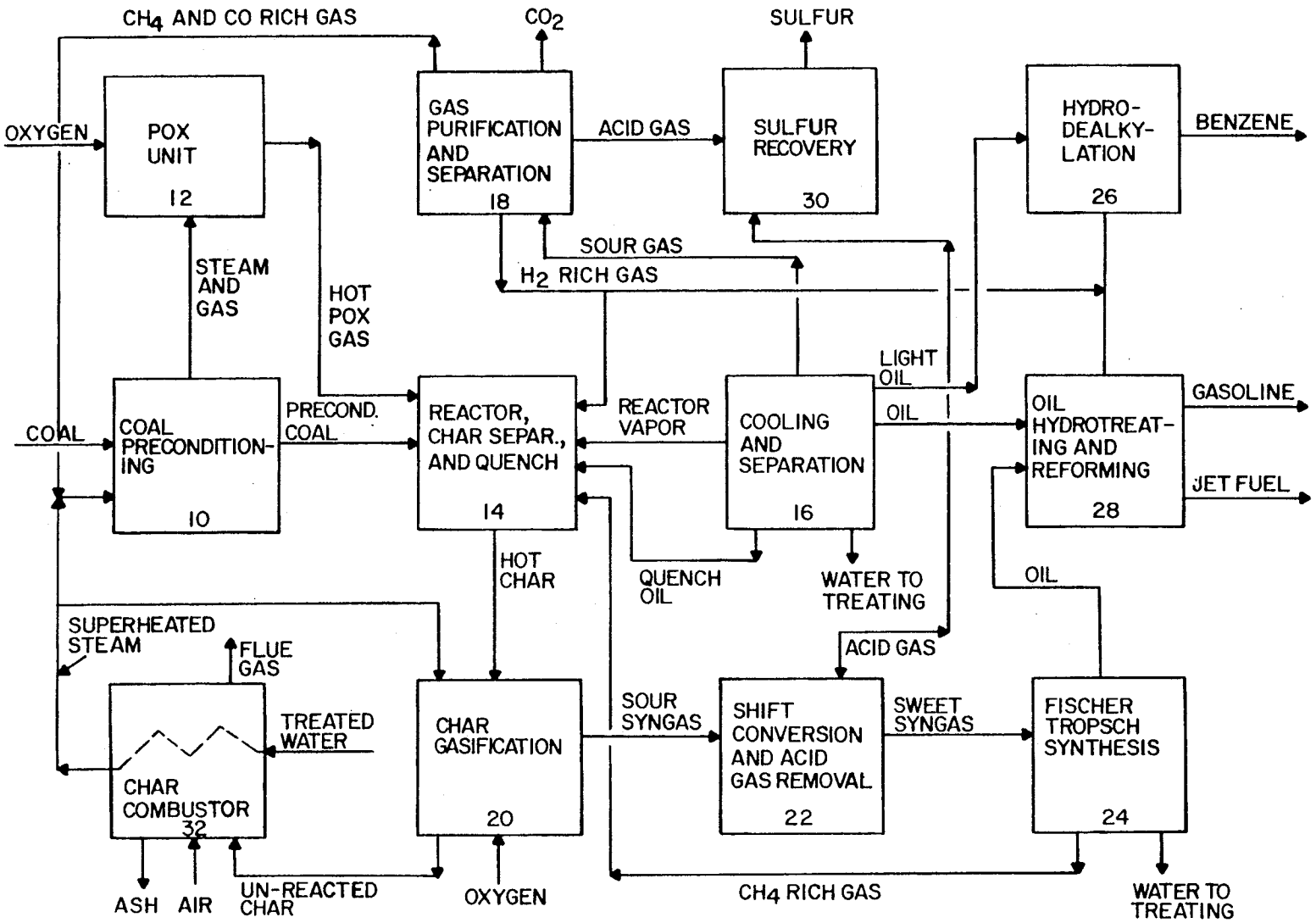
FIG. 1 is a flow sheet schematic for the coal partial liquefaction process of the instant invention where numbered blocks refer to unit process steps and/or facilities as contemplated by the practice of the instant invention and described in the following specification.

The process of the instant invention commences with coal feedstock received at the plant battery limits. Referring to FIG. 1, a coal feedstock is conveyed to a conventional coal grinding and preparation unit (not shown) where the coal is reduced to size and partially dried, if necessary. The sized and partially dried coal is fed to a preconditioning unit 10 (optional) that preconditions and preheats the coal by direct contact with superheated steam and recycled gas from gas purification and separation unit 18. Steam, recycled gas and oxygen from the air separation plant (not shown) are reacted in partial oxidation (POX) reactor unit 12 to produce a hydrogen-rich reducing gas at a high temperature (as later more fully described). The hot POX gas provides the heat, hydrogen, and reducing atmospheres (CO) necessary for short residence time volatilization of the carbonaceous material in the reactor, char separator, and quench unit 14 as well as the make-up hydrogen needed for hydrotreating the liquids in the downstream oil hydrotreating and reforming unit 28 as well as the hydrodealkylation unit 28.

The pre-conditioned coal from unit 10 is contacted with the hot POX gas from unit 12 in reactor unit 14. Preferably, methane and other light hydrocarbon gases produced in the Fischer Tropsch synthesis unit 24 are recycled to reactor unit 14. In accordance with this aspect of the invention, the presence of the gases retard hydrocarbon gas formation during the volatilization/hydrogenation reaction. In accordance with this embodiment, the hydrogen partial pressure in the reactor unit 14 is from about 500 psig to about 1,500 psig and the $CH_4$ partial pressure is from about 200 psig to about 1,000 psig.

The coal particle and hot hydrogen-rich gas are rapidly admixed to volatilize the coal particle to char and HDP vapors in the volatilization reaction. The inlet gas temperature is from about 1,300° F. to about 2,600° F., including mix temperatures in the order of 1,000° F. to about 2,000° F. with a solid to gas ratio of from about 0.5 to about 2.5 by weight. The residence time in the reactor section of unit 14 is from about 0.002 seconds to about 0.100 seconds and preferably 0.010 to 0.075 seconds and more preferably 0.015 to 0.050 seconds depending on the rank of the coal. The reactor pressure is from about 1,000 psig to about 2,000 psig, and preferably from about 1,000 psig to about 1,500 psig.

In order to prevent cracking and continued reactions (polymerization and/or condensation) of heavy unsaturated hydrocarbons, the HDP vapor from the char separator, is subjected to a first quench to effect a hydrogenation temperature in the order of from about 900° F. to about 1500° F., and preferably from about 1000° F. to about 1300° F. with recycle heavy oil and recycle hydrogen-rich gas and subsequently the hydrogenated materials are stabilized by cooling to stabilization temperatures below 1000° F., and preferably below 900° F. with recycled oil/water mixture from unit 16. The hydrogenation reaction occurs for residence times well known in the art depending upon temperature. Residence times of from about 0.1 to about 5.0 seconds have been found adequate for temperatures in the above range.

The hot char produced at 1,000° F. to 2,000° F. is separated from the HDP vapors and is sent to char gasification, unit 20, where it is gasified to produce syngas ($H_2+CO$). Unreacted char from the gasifier is sent to char combustion, unit 32, where it is combusted to produce steam required for preconditioning, unit 10, and char gasification, unit 20.

The hot stabilized vapors are further cooled in a series of heat exchangers to recover heat and scrubbed to remove residual char dust in cooling and separation unit 16. The heavy condensed oil is separated and recycled to unit 14. The separated light oil which is rich in benzene is sent to hydrodealkylation unit 26 where alkylated benzene compounds, such as toluene and xylene, are converted to benzene. High purity chemical grade benzene is produced in unit 26. Separated, middle range boiling oil containing aromatics is mixed with oil produced in Fischer Tropsch synthesis unit 24 and sent to oil hydrotreating and reforming unit 28. The oil produced in the Fischer Tropsch synthesis unit 24 is primarily saturated parafinic oil. The mixture of oil from units 16 and 24 provides an ideal feedstock for the production of high quality gasoline and jet fuel in the oil hydrotreating and reforming unit 28.

The separated water is stripped in water treating unit (not shown) to remove dissolved gases and ammonia. Anhydrous ammonia is then recovered as a co-product and sent to storage (not shown). The stripped water is treated and used to produce steam in char combustor unit 32. Thus, advantageously, there is no anticipated water discharge effluent from the facility, making expensive water clean-up facilities unnecessary.

The non-condensed cooled sour gas from cooling and separation unit 16, which has been scrubbed to remove char dust, is conveyed to the gas purification and separation unit 18 where sulfur compounds, trace impurities and most of the carbon dioxide are removed. The removed sulfur components are sent to a sulfur recovery unit 30 where the sulfur is recovered by conventional means as a co-product and sent to storage (not shown). The separated $CO_2$ is compressed by conventional means to about 2,000 psia and removed by pipeline (not shown) as a co-product for use in enhanced oil recovery, agriculture, and the food industry.

The purified gas is separated in unit 18 into two streams; a hydrogen rich gas stream and a methane-carbon monoxide-rich gas stream. Part of the separated hydrogen-rich gas is compressed and recycled to reactor unit 14, as previously described, and the remainder of the hydrogen rich gas is sent to hydrodealkylation unit 26 and oil hydrotreating and reforming unit 28. The methane-carbon monoxide rich gas stream is preheated (not shown) and recycled to coal pre-conditioning unit 10.

Syngas from char gasification, unit 20, is cooled to recover heat and then sent to shift conversion and acid gas removal unit 22 where CO and steam are reacted to produce additional hydrogen and provide a hydrogen to CO ratio of about 2:1. $H_2S$ and $CO_2$ are the separated from the shifted gas and moved to sulfur recovery, unit 30. The purified syngas, ($H_2$ and CO) are moved to unit 24 and where the $H_2$ and CO are catalytically converted to hydrocarbons by the well-known Fischer Tropsch reactions. The light hydrocarbon gases produced in unit 24 are separated and recycled to unit 14 and injected into the reactor. The oil range hydrocarbons produced in unit 24 are mixed with oil from unit 16 and sent to oil hydrotreating and reforming, unit 28, for upgrading to jet fuel and gasoline. Water produced in unit 24 is moved to water treating (not shown). The treated water from the water treating unit is used as boiler feed water in unit 32.

The carbonaceous materials that can be employed as feedstock in the instant process are, generally, any volatile-containing material which will undergo hydropyrolytic destructive distillation to form a particulate char and volatilization products. Bituminous and subbituminous coals of various ranks and waste coals, as well as lignite, are examples. Peat may also be used. Anthracite is not a preferred feedstock in that the volatiles are minimal.

Lignites are an advantageous starting material for the instant invention since they contain process water for volatilization, as well as up to 55% by weight volatiles (on a dry basis). Additionally, preconditioning of the coal, as disclosed herein, increases liquid yield and lowers the viscosity of such liquids. Its use with the instant invention is economically dependent and is predicated upon the rank of coal being refined.

The physical properties of the coal are also important in the practice of the present process. Coals of higher rank have plasticity and free swelling characteristics which tend to cause them to agglomerate and slake during the hydrodisproportionation process.

The mining and preparation is fully described in KirkOthmer ENCYCLOPEDIA OF CHEMICAL TECHNOLOGY, second edition, Vol. 5, pp. 606–676. The coal is mined by either strip or underground methods as appropriate and well known in the art.

The raw coal, which preferably has a particle size of less than about 5 cm, is normally subjected to crushing to reduce the particle size. Particle size is dependent on the properties of the coal, as well as the need for beneficiation. Preferably, the coal is pulverized to 70 percent minus 200 mesh. The need for size reduction and the size of the reduced material depends upon the process conditions used, as well as the composition and rank of the coal material, particularly its agglomerating tendencies and the inorganic sulfur and ash content of the coal. When beneficiation is necessary, for example, with coals containing a high percentage of ash or inorganic sulfur, the coal is preferably ground and subjected to washing and beneficiation techniques. When coals are used which have agglomerating tendencies, the size of the coal must be matched to the hydrodisproportionation techniques and process conditions in order to produce a particulate char and to prevent agglomeration during HDP.

Coal Preparation

Coal preparation includes coal receiving, storage, reclaiming, conveying, grinding and drying facilities required to prepare the coal for introduction to the pretreatment unit 10. Coal preparation includes facilities to grind or pulverize the feed coal from a received size of 5 cm to 70 percent minus 200 mesh and to dry the coal to from about 1% to 12% by weight and preferably 2% to about 4% by weight moisture.

The crushing, pulverizing and/or grinding can be accomplished with any equipment known in the art, but preferably is accomplished with impact mills such as counter-rotating cage mills, hammer mills or the like. The pulverizers are swept with a stream of heated gas which partially dries the coal. Pulverizer outlet temperature is maintained at from about 100° F. to about 500° F. and preferably from 150° F. to about 400° F.

The ground coal is pneumatically conveyed to a set of cyclones located in coal preconditioner unit 10. Part of the gas from these cyclones is returned to the pulverizer circuits and the remainder of the gas is sent to a bag house prior to being vented to the atmosphere. Fugitive dust collectors are provided at transfer points to minimize coal dust emissions to the atmosphere. Advantageously, carbonaceous fines and the like are subjected directly to hydrodisproportionation.

Coal Preconditioning

Unit 10 of FIG. 1 includes coal pre-conditioning with steam and methane/carbon monoxide ($CH_4$/CO) rich gas. Pneumatically conveyed coal from the coal grinding unit (not shown), is fed to a cyclone separator to separate the coal from the transport gas. Most of the transport gas is recycled back to the coal grinding unit (not shown). A slip-stream is diverted to a bag filter to remove entrained coal dust prior to exhausting to the atmosphere. The coal from the cyclone separators and bag filter is sent to a coal feed surge bin. The coal is normally fed through lockhoppers which are pressurized with high pressure nitrogen from the air separation plant. After an upper lockhopper is filled with coal, it is then pressurized prior to its discharging coal to the lower lockhopper. The emptied upper coal lockhopper is then depressurized to atmospheric pressure and is again filled with coal from the surge bin. Lockhopper valves are controlled, for example, by a microprocessor unit which is used to control the coal filling, pressurization, coal feeding and depressurization sequence.

The coal preconditioning unit 10 is preferably a fluidized bed vessel in which coal from the lockhoppers is contacted with $CH_4$/CO rich recycle gas and steam at from about 1,000 psig to about 2,000 psig, and preferably from about 1,000 psig to about 1,500 psig, at a temperature from about 600° F. to about 1,050°, preferably about 800° F. to about 1,000° F., and more preferably about 950° F. The coal is contacted with the heated gas and steam to provide mixed coal and gas temperatures at a temperature between about 350° F. and about 650° F. The exact temperature will depend upon the coal. Coking and agglomerating coals are especially sensitive to mixing temperatures. The residence time of the coal in the pre-conditioner varies from about 30 seconds to 3 minutes, preferably about 2 minutes, depending on the desired temperature, coal particle size distribution, rank of coal, and throughput rate. The velocity of the steam is preferably adjusted to suspend the coal particles in the steam (fluidized bed). The superheated steam and gas preheats and pre-conditions the coal prior to the coal being fed to the SRT reactor within unit 14. Steam, gas, and entrained coal from the fluidized bed is fed to a separator, for example, an internal cyclone, where the coal is separated and returned to the fluidized bed while the resultant steam and gas stream containing entrained hydrocarbons from the separator is sent to a POX reactor unit 12. These entrained gases have value as fuel in the POX reactor or as a hydrogen source in the reactor in unit 14. The preconditioned coal from the preconditioner is moved to the HDP reactor. Advantageously, the preconditioning is carried out using process heat from both the char and hot gases liberated during the HDP reaction.

Consequently, neither the preconditioning steam nor the entrained hydrocarbons are emitted into the air but, in fact, are used in the POX unit 12. The entrained hydrocarbons are used as a fuel source in the partial oxidation reactor to increase heat and produce hydrogen, CO and the like. Preconditioning is optional depending upon the increased liquid yield of a particular rank of coal versus the capital and operating costs of the preconditioning unit.

Partial Oxidation Unit

Referring to FIG. 1, the partial oxidation (POX) reactor unit 12 comprises any pressurized partial oxidation reactor capable of producing hydrogen donor-rich gas ($H_2$ and CO) and generating gas temperatures in excess of from about 1,300 F. This process produces hydrogen, high quality heat and a reducing atmosphere (CO) for the volatilization reaction, as well as the production of hydrogen for downstream hydrotreating and reducing sulfur and nitrogen. It may be combined as a first stage of the 14 reactor or preferably be a separate unit. In the POX unit, methane-carbon monoxide-rich gas and steam are sub-stoichiometrically reacted with oxygen to produce a hydrogen-rich gas, CO, and high quality heat. The $CH_4$/CO-rich gas is preferably reaction gas from the gas purification and separation unit 18 discussed hereinbelow. The hydrogen-rich gas, the CO and unreacted steam from the POX reactor are at a high temperature and provide the required heat and reducing atmosphere necessary for hydrodisproportionating the coal.

More specifically in the present process, a fuel gas, preferably a CO-rich methane, and more preferably a purified reaction gas, is introduced into a reactor with oxygen. The oxygen is present in an amount less than the stoichiometric amount required to react with all of the fuel gas. An amount of steam sufficient to preferentially inhibit the production of water is also introduced. The steam is preferably derived from preconditioning the coal. The CO in the gas stream is preferred for the selective production of hydrogen by extraction of an oxygen from water. This occurs in accordance with one or more of the following reactions:

| | | |
|---|---|---|
| $CH_4 + \frac{1}{2} O_2$ | → | $CO + 2H_2$ |
| $CH_4 + O_2$ | → | $CO_2 + 2H_2$ |
| $CH_4 + H_2O$ | → | $CO_2 + 3H_2$ |
| $CO + H_2O$ | → | $CO_2 + H_2$ |

Generally, the oxygen is introduced into the POX reactor in an amount to provide a molar ratio of oxygen to $CH_4$/CO within a range from about 0.3 to about 1.25 and preferably from about 0.40 to about 0.90, and most preferably from about 0.5 to about 0.75 based on methane-to-CO ratio on a volumetric ratio of 1 to 1. These ratios will change depending upon the requirement for the heat generated and the composition of the exit gas, specifically the required partial pressure of $H_2$.

The oxygen, fuel gas and steam are reacted in the POX reactor at a pressure of from about 500 psig to about 2,000 psig and preferably from about 700 psig to about 1,500 psig and a temperature within the range from about 1,300° F. to 3,000° F. and preferably from about 1,500° F. to 2,500° F. and more preferably from about 1,800° F. to about 2,300° F.

The POX reaction produces a hot gas stream principally comprising hydrogen, CO and steam along with carbon dioxide and minor amounts of other gases such as nitrogen or the like. The temperature of the POX reaction is controlled such that the hot gas stream produced is essentially free (for example, totaling less than 0.1 volume percent of the total gas stream) of hydrocarbons, oxygen moities and hydroxy moities, although there can be a small amount of methane depending on the conditions.

Reactor, Char Separator, and Quench

Coal from the preconditioner unit 10 is fed to the reactor, char separation and quench unit 14 by gravity and differential pressure. The coal is preferably injected into the reactor through a central feed nozzle where it is rapidly heated to a thermal equilibrium mix temperature of from about 1,000° F. to about 2,000° F., and preferably at about 1,500° F. to 1,750° F. for bituminous coals and 1,300° F. to 1,500° F. for sub-bituminous and lignites. The coal is heated by contacting with hot gas containing hydrogen. The reactor pressures are from about 500 psig to about 2,000 psig and preferably from 600 psig to 1,500 psig.

As discussed hereinabove, in the POX process sub-stoichiometric oxygen and steam are contacted with reaction gas ($CH_4$/CO rich), preferably from gas purification and separation unit 18, to obtain products including primarily CO, $H_2$ and heat. This hot, hydrogen donor-rich reducing gas is contacted with coal from the preconditioning unit to rapidly heat the coal to volatilization temperatures. The coal is heated preferably by intermixing with the gas to from about 1,000° F. to about 2,000° F. at from about 500 psig to about 2,000 psig and is hydrodisproportionated with the volatilized material undergoing hydrogenation.

The hot POX gas rapidly heats the coal at a heating rate of at least about 10,000° F./second and at ranges from about 10,000° F./second to about 250,000° F./second.

Prior to contacting the coal, the hot gas is accelerated to a velocity to effect intimate contact of the particulate coal with the hot gas stream and to volatilize the coal within a residence time in the reactor of from about 2 milliseconds to about 2.0 seconds, and preferably from about 20 milliseconds to about 1 second, and more preferably from about 25 milliseconds to about 150 milliseconds, with the most preferred residence time being 30 to 75 milliseconds. The hot gas is accelerated to velocities in the range of from about 200 feet per second to about 1,000 feet per second, and preferably from about 300 feet per second to 800 feet per second, and most preferably from about 400 feet per second to 600 feet per second to effect mixing of solid and gas.

The amount of particulate coal and the amount of hot gas introduced into the HDP process can be controlled to produce the desired reaction temperature and residence time. The higher the partial pressure of hydrogen and CO and the higher the partial pressure of steam in the HDP reactor, the more saturated hydrocarbons and $CO_2$ are produced. The reactants and products from the HDP process are rapidly cooled after char separation to effect the desired total hydrodisproportionation reaction exposure time.

The POX reaction and volatilization processes may be accomplished in two separate reactors or within a single vessel. In this latter configuration, the carbonaceous feed is introduced into the hot, hydrogen donor-rich gas generated in a first stage to provide heat and reactants to effect the downstream second stage. The direction of flow of the products through the reactors or vessel is dependent only upon the longitudinal axial alignment of the reactors or single reactor vessel. By using high velocity flows to propel the reaction products through the reactors, the direction of axial alignment of the reactors or vessel can be varied. The prior art injected oxygen into the downstream volatilization reaction for heat. Any oxygen present in the volatilization reaction of the instant invention is from oxygen in the coal molecule. The important aspect is that there is no "free" oxygen in the feed to the HDP reactor so that water formation is not the preferential reaction. Preferably, the POX reaction of the process is accomplished in a separate unit. In this method, the outlet end of a POX reactor section is connected in close proximity to the inlet end of a reaction section designed to accomplish the volatilization reaction. The two reactor sections can comprise two physically separate compatible reactors utilizing a high product flow rate, short-residence time, entrained-flow reactor; or the two reaction stages may be integral parts or zones of a single unit. The direction of axial alignment of the reactor is not important since high velocity entrained flow is not gravity dependent so long as the high rate of flow and short exposure time required to achieve the desired product slate is provided.

Other embodiments of the two-stage process are possible utilizing either a single vessel or separate reactors. The direction of product movement through the first and second stages is not limited to either upflow or downflow when a high velocity propelling force is used to overcome gravitational forces and to insure proper heating profiles and rapid product movement through the reactors.

This two-stage process can be used for the reaction of any solid or semi-solid or even liquid carbonaceous material. Preferably, oxygen is introduced to the POX unit 12 in substoichiometric amounts to maintain the desired operating temperature range in the second-stage volatilization. Steam is added to effect material balance, to enhance the phase shift reaction, and to inhibit the production of water. The amounts are empirical to the feedstock and desired product slate. Steam requirements are therefore dependent upon the second-stage carbonaceous material feed rate, the type of carbonaceous feed introduced, and the operating conditions in the second stage, etc.

Higher temperatures and longer high temperature exposure times in the second stage create a need for greater amounts of hydrogen in the second stage as heavy hydrocarbons are cracked to lighter material. In order to meet second-stage hydrogen requirements, for example, 0.05 to 0.25 pounds of $H_2$ per 1 pound of carbonaceous material is required to be fed into the second stage.

The instant process which involves the rearranging of hydrogen and the use of hydrogen from constituents in the carbonaceous material has certain limits. Specifically, the amount of hydrogen that can be produced in this manner is finite. It has been found, however, that with most coals, except anthracite, devolatilization of the coal, cracking of heavier material, and even hydrogenation of some portion of the solid carbon is possible. Of course, the more hydrogen in the feedstock, the more valuable is the fuel produced.

A refractory-lined reactor vessel can be used to volatilize the carbonaceous material. The refractory vessel can be cylindrical or rectangular in shape.

As part of the unit 14 reactor configuration, an injector system is preferably used for rapidly injecting the particulate coal and rapidly admixing and heating the coal with a hot, hydrogen-rich stream of reducing gases. The coal injector can be centrally located or form a series of manifolded injectors dispersed on the head portion of the reactor. The carbonaceous material and hot gas are preferably injected through rectangular shaped slots with the hot gas stream injection angle not greater than 60 degrees when measured from a horizontal plane. The means for particle injection can be any means known in the art such as gravitational flow, differential pressure, entrained flow, or the like.

The following discussion explains the distinction between the instant invention and the prior art pyrolysis process. The following is advanced as explanatory theory only and should not be construed as a limitation of the instant invention. The rapid volatilization and decomposition of volatile containing carbonaceous material is accomplished by heating the carbonaceous material very rapidly to effect a high heating rate (second order function) to a volatilization temperature. This heating rate has been found to increase $k_1$ and minimize the "condensation" reaction rate $k_2$. When decomposition is accomplished at higher heating rates, i.e., in excess of 10,000° F., the decomposed volatilized material is decomposed, fragmented, and "blown out" of the particle as low molecular weight hydrocarbons containing free radical sites. If hydrogen is present in the atmosphere surrounding this decomposed material as it exits the particle, the decomposed material is hydrogenated. If the condensation reaction is allowed to proceed at lower heating rates, then the presence of hydrogen in the atmosphere is not as effective.

However, in order to effect high heating rates, the mixing temperature must be relatively high to impart sufficient energy to the coal particle to heat it rapidly in milliseconds of time. These high temperatures, however, dilitariously effect the formation of hydrogenated liquids and promote cracking to gaseous products which use up hydrogen and degrade liquid production.

By immediately adjusting the temperature of the decomposed volatilized material to a hydrogenation temperature (as opposed to stopping the reaction by "stabilization quenching") in the presence of hydrogen, $k_3$ is increased and hydrogenated, light liquids are produced. Therefore, the concentration of decomposition material available to undergo the "condensation" reaction with reaction constant $k_2$ is minimized. Adjustment of temperature to a hydrogenation temperature also minimizes high temperature thermocracking to gases heretofore believed a necessary product of high heating rate volatilization processes.

The hydrogenated products may be further quenched to cease all reactions after the decomposition products have been sufficiently hydrogenated. Thus, in accordance with the instant invention, the initial heating rate of the coal does not have to determine the ultimate slate of volatilization products, including large amounts of gas, and the condensation reaction can be effectively avoided.

Char Separation

The vapor and char is sent to a primary char separation apparatus within unit 14 where most of the char is separated from the vapor. The vapor stream is then sent to a secondary separator to remove additional char. The vapor, now containing only a small amount of char dust, is quenched and then conveyed to cooling and separation unit 16.

Quench

Within the reactor, char separator, and quench unit 14 is located one or more sets of quench nozzles. Preferably, anterior of the reactor vessel, disposed in an annular fashion about the circumference of the vessel, are one or more sets of quench nozzles through which a quench medium is dispensed to slow down and/or terminate the reaction and reduce the temperature of the reaction products. The temperature reduction is preferably accomplished in a single or series of quench steps. Hydrogen rich gas is a preferred quench medium. Heavy process oils which undergo hydrocracking during the quench are greatly preferred.

The vapor is subjected to an instant quench to ultimately stop the volatilization reaction and provide a direct heat exchange. This may take place in two or more steps which may be overlapping. In a particularly preferred embodiment, a two-step quench is used to minimize the condensation reaction, i.e., formation of high viscosity tars and/or the formation of gas. In the first step, the heavy oil produced in the HDP reaction is recycled as a primary quench medium. This quench medium is injected directly through a first set of quench nozzles to effect a temperature reduction to hydrogenation temperatures, as well as a "thermal cracking" of the heavy oil and tars. In a preferred embodiment, a recycled hydrogen donor-rich gas is used as an additional initial quench medium.

Additional hydrogenation can be accomplished in the presence of a catalyst by reducing the reactant temperature to inhibit excessive hydrocracking and promote hydrogenation. Temperatures in the range of from about 700° F. to about 1300° F., and preferably in the range of from about 900° F. to about 1000° F. are sufficient at residence times in the order of from about 5 seconds to about 15 seconds.

The second quench step, when two or more quenches are used, employs recycle water and lighter oils or indirect heat exchange to reduce the temperature of the HDP volatiles to a temperature stabilization temperature below about 900° F., preferably from about 700° F. to about 900° F. to prevent reaction (polymerization) of unsaturated hydrocarbons and free radicals and to inhibit further "thermal cracking" to gas.

The quantity of quench liquid is determined by its latent heat of vaporization and heat capacity or ability to absorb the sensible heat of the HDP vapors. The quench liquid can comprise any liquids or gases that can be blended rapidly and in sufficient quantity with the reactant mixture to readily cool the mixture below the effective reaction temperature. The cooling down or quenching of the reactant HDP vapors occurs in the pipe line from the char separator by quench nozzles located in the pipe line.

The short exposure time in the HDP is conducive to the formation of aromatic liquids and light oils. It has been found that rapid heating of carbonaceous materials not only "drives out" the volatiles from the feed particles (devolatilization), but also thermally cracks larger hydrocarbons into smaller volatiles which escape from the host particle so rapidly that condensate reactions are largely bypassed. With a rapid quench to hydrogenation temperatures, these volatiles are first stabilized by reaction with hydrogen to form a less reactive product and then by lowering the internal energy of the volatiles below the reactive energy level. The net result is the rapid production of these volatiles to prevent polymerization to heavy oil or tar (high molecular weight compounds) and the maximization of lighter hydrocarbon liquids.

The HDP reactor product slate includes primarily $H_2$, CO, $CO_2$, $H_2S$, $NH_3$, $H_2O$, $C_1$ to $C_4$ hydrocarbons, benzene, toluene, and xylene, minus 700° F. boiling liquids and plus 700° F. boiling liquids. The product slate is dependent upon the coal type and operating parameters, such as pressure, temperature, and second-stage residence time, which can be varied within the reactor system. It has been found that the presence of CO, $CO_2$, and $CH_4$ in the feed to the second-stage HD reactor does not inhibit the production of benzene, toluene, xylene (BTX) and other liquid products in a short-exposure time, high-temperature hydropyrolysis. $CO_2$ is merely a diluent which has little effect on the second-stage reactions. It has been found that $CH_4$ in the feed to the second stage reactor can inhibit $CH_4$ produced in the reactor and thereby increase oil yield and conserve hydrogen. The concurrent presence of water vapor is required to inhibit the formation of water ($H_2 + \frac{1}{2}O_2 \rightarrow H_2O$) and the net reaction extracts hydrogen from water to provide some of the hydrogen consumed in the hydrogenation reactions. Hydrogen is extracted from water vapor in the first-stage to satisfy the hydrogen needs in the second-stage.

The total carbon conversion, expressed as the percentage of the carbon in the gases and liquids found in the second-stage end products to the total amount of carbon in the second-stage carbonaceous feed material ranges from about 40 weight percent to about 70 weight percent. The component carbon conversion expressed as the percentage of carbon converted to that component in the second-stage end product to the amount of carbon in the second-stage carbonaceous feed material ranges as follows: $C_1$–$C_4$ hydrocarbons from about 2 weight percent to about 10 weight percent; BTX from about 1 weight percent to about 20 weight percent; minus 700° F. boiling liquids (excluding BTX) from about 20 weight percent to about 50 weight percent; and plus 700° F. boiling liquids from about 10 weight percent to about 30 weight percent.

The second-stage product gases are useful for the extraction of marketable by-products such as ammonia, as a hydrogen source for hydrotreating the product oil to produce transportation fuels, fuel oil, etc.

Cooling and Separation (Fractional Condensation)

The char dust is scrubbed from the quenched, stabilized vapor and the vapor is cooled and condensed in unit 16. Cooling and separation unit 16 accepts the stabilized vapor which has been hydrogenated and quenched having a temperature of from about 700° F. to about 1,000° F. and preferably 850° F. in four consecutive cooling steps. Liquid hydrocarbons and water are also condensed and collected for separation in an oil-water separator within unit 16. Facilities in unit 16 also scrub the ammonia from the remaining noncondensible sour gas to less than 10 ppm before the sour gas sent to gas purification and separation unit 18.

Within unit 16, a first cooling step is accomplished. In this step, the vapor at about 850° F. entering from unit 14 is cooled to about 520° F. in a heat exchanger. Saturated steam is generated in this exchanger. This partially cooled vapor stream is then sent to a scrubber and then to a vapor-liquid separator where condensed heavy hydrocarbons are separated from the cooled vapor stream. Part of the condensed liquid from the bottom of the separator is recirculated to the scrubber where it contacts the partially cooled vapor stream to remove residual entrained char dust from the vapor. The remainder of the condensed heavy hydrocarbons are recycled to unit 14 to act as the first quench fluid as previously described.

In a second cooling step, the vapor which has been cooled in the first step to about 520° F. is circulated through a second heat exchanger where it is cooled to about 300° F. by generating lower temperature saturated steam. This stream, thus cooled, is moved to a second separator where condensed oil and water are separated from the cooled stream. The separated liquids are then separated in an oil-water separator within unit 16.

The remaining cooled stream from this second separator is circulated through a third heat exchanger in a third cooling step where it is further cooled by preheating boiler feed water to about 290° F., creating a liquid-vapor stream. The cooled liquid-vapor stream then goes to a third separator for separation of the liquid from the vapor. The separated liquid stream (oil and water) is sent to an oil-water separator within unit 16.

In a fourth cooling step, vapor from the third separator is sent to an air cooler where it is cooled to about 145° F. with air and then cooled to about 100° F. by a water cooled exchanger.

This cooled vapor-liquid stream goes to a fourth separator (bottom section of the ammonia scrubber) where the light condensed oil and water are separated. The remaining vapor then proceeds to a packed bed section in the ammonia scrubber previously described where it is contacted with water to remove any remaining ammonia and hydrogen cyanide and is sent to gas purification and separation unit 18. The remaining material, a condensed light oil and water, is sent to a light oil-water separator within unit 16.

The oil-water stream from the second separator, as previously described, is cooled and admixed with oil from the third separator. The admixture is sent to an expansion drum within unit 16 wherein the pressure is reduced and where most of the dissolved gases in the oil-water mixture are released to flare (not shown). The de-gassed oil-water mixture is sent to an oil-water separator within unit 16 where the oil is separated from the water. The oil separated from the water (400° F.+ boiling hydrocarbons) is sent to unit 28. Water from the bottom of the oil-water separator is sent to water treating (not shown).

The light oil-water stream from the fourth separator is sent to a light oil expansion drum within unit 16. The gas released in the expansion drum is mixed with the gas from the heavy oil expansion drum and then cooled to 105° F. in a water cooled heat exchanger. The light oil-water mixture from the expansion drum is sent to a separator where the light oil is separated from the water. Separated light oil consisting primarily of BTX is sent to unit 26. Water from the bottom of the oil-water separators is sent to water treating (not shown).

The stripped ammonia and sulfur-containing acid gas are sent to an ammonia absorber where the ammonia is selectively separated from the acid gas, utilizing for example, a lean ammonium phosphate solution as the solvent. The acid gas from the absorber overhead is sent to the sulfur recovery unit 30, which may be, for example, a Claus unit. The anhydrous ammonia, after separation from the water, is condensed and pumped to storage (not shown).

Gas Purification and separation

All of the gas handling facilities required for gas purification and separation are contained within unit 18. Gas purification and separation unit purifies sour gas from the cooling and separation unit 16. Sulfur components are removed to less than 0.2 ppm and removes carbon dioxide to less than 1.0 percent. Organic sulfur and trace quantities of ammonia and hydrogen cyanide are also removed from the gas. An example of such a commercially available gas purification unit is the "Rectisol" process licensed by Lurgi, Frankfurt, West Germany.

A compressor for carbon dioxide is included in unit 18. $CO_2$ off-gas separated from the sour gas is sent to, for example, a two case, electric motor driven, centrifugal compressor where the $CO_2$ is compressed in 4 stages with air coolers followed by water cooled exchangers. An air after-cooler followed by a water cooler is also provided to cool the compressed (fluid) $CO_2$ to about 100° F. prior to being sent to a pipeline.

Hydrogen is separated from the purified gas within unit 18. The separated hydrogen is recompressed prior to its recycle to the unit 14. In addition, part of the separated hydrogen is sent to hydrodealkylation unit 26 and oil hydrotreating and reforming unit 28. Most of the separated gas, primarily methane and carbon monoxide, is heated and sent to the pre-conditioning unit 10 prior to being partially oxygenated in the POX unit 12.

Purified gas from unit 18 is sent to, for instance, a membrane separator (not shown). In the membrane separator, $H_2$ is separated from the other gases by semi-permeable membranes formed, for example, into hollow fibers. The separated hydrogen (containing small amounts of $CO_2$, CO, and $CH_4$) is compressed in a hydrogen compressor. Part of the compressed, hydrogen rich gas is then recycled to unit 14. The remainder of the hydrogen rich gas is sent to hydrodealkylation unit 26 and oil hydrotreating and reforming unit 28. The remainder of the separated gas (primarily $CH_4$ and CO) is heated and sent to the preconditioning unit 10. Other processes for gas separation, such as cryogenic separation, can alternatively be used.

Char Gasification and Syngas Processing

Hot char from the char separation unit 14 is gasified with steam and oxygen within unit 20. The char is preferably gasified in a fluid bed gasifier at a temperature below the ash slagging temperature. The nongasified char is then sent to a char combustor unit 32 (preferably a circulating fluidized bed boiler) to generate superheated steam required in coal preconditioning unit 10 and char gasification unit 20. The syngas product from char gasification containing primarily CO, $H_2$, and steam with lesser amounts of $CO_2$, $H_2S$, $NH_3$, and $CH_4$ is sent to shift conversion and acid gas removal unit 22, where the $H_2$ to CO ratio is adjusted to a molar ratio of approximately 2:1 utilizing standard sour gas shift conversion catalyst.

The shift conversion gas is moved to acid gas removal within unit 22, where acid gas ($CO_2$ and $H_2S$) are removed and sent to sulfur recovery unit 30, leaving a sweetened syngas. Commercially available processes, such as Selexol, Rectisol, Benefield, etc., can be utilized to remove $CO_2$ and $H_2S$ from the syngas.

The sweet syngas is moved to Fischer Tropsch synthesis unit 24 where $H_2$ and CO are catalytically reacted to produce hydrocarbons and water. Light hydrocarbon gases are separated, compressed, and heated prior to recycle to unit 14. Water is separated from liquid hydrocarbons and moved to water treating for treating (not shown). The treated water is moved to char combustor unit 32 to generate steam, as previously described. Liquid hydrocarbons produced in unit 24, primarily parafins and olefins boiling in the gasoline and diesel range, are sent to unit 28.

Hydrodealkylation

Unit 26 represents a facility to convert alkylated benzenes and substituted aromatics to benzene and to hydrodesulfurize and hydrodenitrofy to produce high purity, chemical grade benzene. Yields are essentially stoichiometric. The light oil from unit 16 is distilled to separate $C_9+$ hydrocarbons from the $C_8-$ distillate. The $C_9+$ hydrocarbons are sent to unit 28. The $C_8-$ distillate is sent to a two-stage catalytic reactor system within unit 26 to remove heteroatoms and convert substituted aromatics to benzene, toluene, and xylene, primarily benzene. The benzene is separated from other components by distillation, and the toluene and xylene are recycled to extinction in the process. Commercial processes, such as Houdry's Litol[198] process, are available for producing benzene from coal-derived light oils.

Oil Hydrotreating and Reforming

Oil hydrotreating and reforming unit 28 represents a facility for hydrotreating, hydrocracking, hydrodesulfurizing, and hydrodenitrofying distillate oil from unit 16 and unit 24. Highly aromatic oil from unit 16 is admixed with highly parafinic and olefinic oil produced in unit 24 and hydrogen from unit 18, as previously described, and moved to a two-stage catalytic reactor system where heteroatoms are removed, unsaturated hydrocarbons are hydrogenated, and heavier hydrocarbons are hydrocracked to hydrocarbons boiling below about 560° F. The treated oil stream is distilled to produce a minus 400° F. to 560° F. bottoms product. The 400° F. to 560° F. product meets jet fuel A specifications. The minus 400° F. naphtha is moved to a reforming facility within unit 28.

Hydrotreating and hydrocracking processes used in unit 28 for upgrading the distillate oil are commercially available.

The naphtha produced in the oil hydrotreater within unit 28 is moved to a catalytic reformer where the octane rating is increased to produce a high octane gasoline product.

EXAMPLE

The following example with reference to FIG. 1 is used to demonstrate the feasibility of the instant invention. The facility is designed to convert 10,000 tons (moisture, ash free) per day of Wyoming Powder River Basin coal feed to liquid hydrocarbon products. Dry, pulverized coal at 200° F. is fed to a preconditioner unit 10 which is a fluidized bed vessel and contacted with 1,000 psig, 950° F. steam at a rate of 415,000 pounds per hour and recycled $CH_4$/CO-rich gas from unit 18 also heated to 950° F. The coal from the preconditioner at a temperature of 550° F. is separated from the steam and gas and fed to a reactor designated unit 14 and subjected to rapid volatilization, char separation, hydrogenation, and quench. 40,000 pounds per hour of light hydrocarbon gases produced in unit 24 and preheated to 900° F. is recycled to the reactor to inhibit light hydrocarbon gas formation in the HDP reactor. Steam and gas from the preconditioner at about 550° F. is sent to a cyclone separator to separate entrained coal particles. The steam and gas are fed to a POX unit 12. In the POX reactor, the steam and recycled gas are reacted with about 200,000 pounds per hour of oxygen (substoichiometrically) to produce a hydrogen-rich reducing gas stream containing water at about 2,250° F. and 975 psig. The hot gas from the POX unit is directly fed to the SRT-HDP reactor operating at about 950 psig to heat the coal and recycle methane to about 1,500° F., at which temperature the coal is volatilized. The residence time in the reactor prior to char separation is between 15 milliseconds and 30 milliseconds. The HDP vapors and char are immediately separated and the volatilization vapor partially quenched to about 1200° F. with about 150,000 pounds per hour of recycled heavy quench oil and 70,000 pounds per hour of recycle hydrogen. At these conditions, heavy oil is partially cracked to lighter oil and the reactor product is partially hydrogenated.

The gas and HDP vapor is further proceeded as shown in FIG. 1 to recover and upgrade liquid hydrocarbons, purify noncondensible gases, separate hydrogen for recycle to the quench unit and oil treating units, and recover gas for recycle to the POX unit 12. The hot separated char is gasified with about 185,000 pounds per hour of oxygen and 150,000 pounds per hour of steam to produce synthesis gas consisting primarily of hydrogen and carbon monoxide. The synthesis gas is further processed to produce liquid and hydrocarbon gases, purify noncondensible gases, and separate light hydrocarbon gases for recycle to the HDP reactor. The hydrocarbon products produced are 4,640 BPD of chemical grade benzene; 15,250 BPD of high octane gasoline; and 4,460 BPD of jet fuel.

What is claimed is:

1. An improved method for refining a volatile containing carbonaceous material in a partial liquefaction type process to produce a slate of hydrocarbon-containing products wherein char is gasified with oxygen and the resulting syngas subjected to a Fischer Tropsch type synthesis to produce liquids and a methane-rich gas comprising the steps of:

(a) heating a particulate volatile containing carbonaceous material at a heat rate sufficient to maximize decomposition and minimize formation of char and condensation products to a volatilization temperature effective to produce a substantially decomposed volatilization product and char; and (b) contacting said substantially decomposed volatilization product with a hydrogen donor-rich gaseous atmosphere at a hydrogenation temperature effective to minimize formation of condensation products and reduce thermal cracking for a hydrogenation residence time effective to produce a hydrogenated volatilization product wherein said hydrogen donor-rich gaseous atmosphere is produced in substantial part from said carbonaceous material, including the gasification of said char.

2. The method of claim 1 comprising the further step of producing stabilized hydrogenated product by adjusting the temperature of said hydrogenated volatilization product to a stabilization temperature effective to substantially terminate formation of condensation products and thermal cracking of said hydrogenated volatilization product.

3. The method of claim 1 wherein said heating rate is at least about 10,000° F. per second and said volatilization temperature is from about 1,000° F. to about 2,000° F.

4. The method of claim 1 wherein said hydrogenation temperature is from about 900° F. to about 1,500° F. and said hydrogenation residence time is from about 0.1 seconds to about 5.0 seconds.

5. The method of claim 2 wherein said stabilization temperature is below about 1,000° F.

6. The method of claim 1 wherein said hydrogenation temperature is effected by direct partial quench.

7. The method of claim 6 wherein said direct partial quench is effected by using hydrogen donor-rich gas, or heavy hydrocarbon process liquid which heavy hydrocarbon process liquid is thermally cracked to produce lighter process liquids during said partial quench, or mixtures thereof.

8. The method of claim 1 wherein said hydrogen donor-rich gaseous atmosphere is obtained in substantial part from gasification of said char and wherein at least a part of said hydrogen donor-rich gaseous atmosphere and said volatilizing temperatures are produced in substantial part in a partial oxidation reaction wherein steam and hydrodisproportionation recycle gas rich in methane and carbon monoxide are reacted with a sub-stoichiometric amount of oxygen.

9. The method of claim 1 wherein said carbonaceous material is selected from a group consisting of coals, lignites, low rank and waste coals, peats, and mixtures thereof.

10. The method of claim 1 further comprising the addition of a methane-rich gas to said heating step in an amount effective to inhibit hydrocarbon gas formation wherein a substantial part of said methane is obtained from the gasification of said char.

11. An improved method for refining a volatile containing carbonaceous material in a partial liquefaction-type process to produce a slate of hydrocarbon-containing products wherein char is gasified with oxygen and the resulting syngas is subjected to a Fischer Tropsch type synthesis to produce liquids and a methane-rich gas comprising the steps of:

(a) heating a particulate volatile containing carbonaceous material by admixing said particulate with a gaseous heating medium at a volatilization temperature of from about 1,000° F. to 2,000° F. and at a decomposing heat rate of at least 10,000° F. per second to produce a substantially decomposed volatilization product and char;

(b) contacting said substantially decomposed volatilization product with a hydrogen donor-rich reducing gaseous atmosphere consisting essentially of hydrogen, steam, and carbon monoxide at a temperature of from about 900° F. to about 1,500° F. and at a hydrogenation residence time of from about 0.1 seconds to about 5.0 seconds to produce a hydrogenated volatilization product, said hydrogen and carbon monoxide being formed in substantial part in a partial oxidation reaction wherein steam and a hydrodisproportionation recycle gas rich in methane and carbon monoxide are reacted with a substoichiometric amount of oxygen wherein at least a portion of said methane is obtained from said gasification of said char; and (c) cooling said hydrogenated volatilization product to reduce the temperature of said product to below about 1000° F., said cooling accomplished at a rate to provide a total residence time from the heating of said carbonaceous material to said cooling of said hydrogenated volatilization product of between about 0.02 seconds and about 5.0 seconds.

12. The method of claim 11 wherein said contacting step temperature is effected by direct partial quench.

13. The method of claim 12 wherein said direct partial quench is effected by using a hydrogen donor-rich gas, or heavy hydrocarbon process liquid which heavy hydrocarbon process liquid is thermally cracked to produce lighter process liquids during said partial quench, or mixtures thereof.

14. The method of claim 11 wherein said hydrogen in said reducing gaseous atmosphere is obtained in substantial part from said carbonaceous material.

15. The process of claim 11 wherein said carbonaceous material is selected from a group consisting of coals, lignites, low rank and waste coals, peats, and mixtures thereof.

16. An improved method for refining a volatile containing coal by a partial liquefaction process employing a Fischer Tropsch type synthesis of syngas from process char to produce a slate of hydrocarbon containing co-products by short residence time hydroisproportionation comprising the steps of:

(a) containing a particulate coal with a hydrogen donor-rich reducing gaseous mixture having a temperature in the range of about 1,300° F. to about 3,000° F. to heat said particulate coal at a volatilization temperature of from about 1,000° F. and about 2,000° F. at a heating rate greater than about 10,00° F. per second at pressures of from about 100 psig to about 2,000 psig for a time of from about 0.002 seconds to about 2.0 seconds to produce a substantially decomposed volatilization product and char, wherein said hydrogen donor-rich gaseous reducing gaseous mixture is obtained in substantial part from said carbonaceous material by a partial oxidation reaction wherein steam and hydroisproportionation recycle gas rich in methane and carbon monoxide are reacted with a sub-stoichiometric amount of oxygen and wherein said methane is produced in substantial part from the gasification of said char with a substoichiometric amount of oxygen in a gasifier;

(b) cooling said substantially decomposed volatilization product to temperatures from about 900° F. to about 1,500° F. for residence times of from about 0.1 seconds to about 5.0 seconds to produce a hydrogenated volatilization product, wherein said cooling is effected by direct partial quench by using a hydrogen donor-rich gas or a heavy hydrocarbon process liquid, which heavy hydrocarbon process liquid is thermally cracked to produce lighter process liquids during said partial quench or mixtures thereof; and (c) stabilizing said hydrogenated volatilization product at a temperature of less than about 1,000° F. to produce a stabilized hydrogenated volatilization product wherein said stabilization is accomplished by contacting the hydrogenated volatilization product with a mixture of water and lighter oils, said mixture being recycled from said hydrodisproportionation process.

17. The process of claim 16 wherein said contacting is accomplished at a volatilization temperature of from about 1,200° F. to about 1,750° F. and a heating rate greater than about 50,000° F. per second and a residence time of from about 0.05 seconds to about 0.5 seconds.

18. The process of claim 16 wherein said cooling is accomplished at temperatures of from about 1,100° F. to about 1,300° F. and residence time of from about 0.2 to about 2.0 seconds.

19. The process of claim 15 wherein said stabilization step is accomplished at temperatures less than about 900° F.

20. The method of claim 16 wherein said partial oxidation reaction is carried out at temperatures of from about 1,800° F. to about 2,500° F. and pressure of from about 1,000 psig to about 2,000 psig with a mole equivalent of oxygen to $CH_4/CO$ of from about 0.5 to about 0.75.

21. The method of claim 16 wherein prior to said contacting, the particulate coal is first subjected to a preconditioning step wherein the carbonaceous material is contacted with $CH_4/CO$ rich recycle gas at from about 1,000 psig to about 2,000 psig at a coal/gas mix temperature of from about 450° F. to about 650° F. at residence times of from about 30 seconds to about 3 minutes.

22. The method of claim 16 comprising the addition of methane-rich gas to said heating step in an amount effective to inhibit the formation of hydrocarbon gas.

* * * * *